US008278888B2

(12) United States Patent
Egan et al.

(10) Patent No.: US 8,278,888 B2
(45) Date of Patent: Oct. 2, 2012

(54) MULTIPLE BRANCH ALTERNATIVE ELEMENT POWER REGULATION

(75) Inventors: Patrick K. Egan, Rochester, MN (US); Jordan R. Keuseman, Rochester, MN (US); Michael L. Miller, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/230,466

(22) Filed: Sep. 12, 2011

(65) Prior Publication Data

US 2012/0001602 A1 Jan. 5, 2012

Related U.S. Application Data

(63) Continuation of application No. 12/535,191, filed on Aug. 4, 2009, now Pat. No. 8,040,115.

(51) Int. Cl.
*G05F 1/00* (2006.01)

(52) U.S. Cl. ..... 323/266; 323/269; 323/270; 323/272

(58) Field of Classification Search ..... 323/222, 323/266, 270, 272, 265, 268, 271, 282
See application file for complete search history.

(56) References Cited

U.S. PATENT DOCUMENTS

| | | | | |
|---|---|---|---|---|
| 4,074,182 | A | 2/1978 | Weischedel | |
| 4,766,364 | A | 8/1988 | Biamonte et al. | |
| 5,122,726 | A | 6/1992 | Elliott et al. | |
| 5,491,786 | A | 2/1996 | Egan et al. | |
| 5,691,629 | A | 11/1997 | Belnap | |
| 5,945,816 | A * | 8/1999 | Marusik | 323/273 |
| 6,198,261 | B1 | 3/2001 | Schultz et al. | |
| 6,232,754 | B1 | 5/2001 | Liebler et al. | |
| 6,362,608 | B1 | 3/2002 | Ashburn et al. | |
| 6,414,470 | B1 | 7/2002 | Liu et al. | |
| 6,515,460 | B1 | 2/2003 | Farrenkopf | |
| 6,771,052 | B2 | 8/2004 | Ostojic | |
| 6,798,177 | B1 | 9/2004 | Liu et al. | |
| 6,836,100 | B2 | 12/2004 | Egan et al. | |
| 6,989,660 | B2 * | 1/2006 | Mauthe | 323/274 |
| 7,170,267 | B1 | 1/2007 | McJimsey | |
| 2004/0013321 | A1 * | 1/2004 | Ohkawa | 382/325 |
| 2006/0022650 | A1 | 2/2006 | Vinciarelli | |
| 2006/0055244 | A1 * | 3/2006 | Ito et al. | 307/10.8 |
| 2006/0250119 | A1 | 11/2006 | Ostrom et al. | |
| 2007/0080675 | A1 * | 4/2007 | Gray et al. | 323/282 |

* cited by examiner

*Primary Examiner* — Nguyen Tran
(74) *Attorney, Agent, or Firm* — Matthew C. Zehrer

(57) ABSTRACT

A power regulation scheme includes a first voltage regulation portion connected in parallel with a second voltage regulation portion that regulates a voltage if an open condition occurs within the first voltage regulation portion. Each voltage regulation portion may include a first voltage regulator connected in series with a second voltage regulator that regulates the voltage if a short condition occurs within the first voltage regulator. Each voltage regulation portion may utilize a switching element to route an output voltage of the first voltage regulator past the second voltage regulator if the output voltage has been regulated and/or to force the output voltage to be regulated by the second voltage regulator if the output voltage has not been regulated.

16 Claims, 7 Drawing Sheets

MULTIPLE BRANCH ALTERNATIVE ELEMENT POWER REGULATION

CROSS-REFERENCE TO RELATED APPLICATION

This application is a continuation of Ser No. 12/535,191, now U.S. Pat. No. 8,040,115, filed on Aug. 4, 2009, entitled "MULTIPLE BRANCH ALTERNATIVE ELEMENT POWER REGULATION," which is herein incorporated by reference.

BACKGROUND

1. Field of the Embodiments of the Invention

Embodiments of this invention relate generally to field of electronics and more specifically relate to a power regulation scheme that may be utilized in computer processing systems or other electronic devices.

2. Description of the Related Art

A voltage regulator is an electrical component that outputs a constant voltage level. A voltage regulator may use an electromechanical mechanism, or passive or active electronic components, and depending on the regulator type, it may be used to regulate one or more AC or DC voltages.

SUMMARY OF THE INVENTION EMBODIMENTS

In an embodiment of the present invention, a power supply includes a first voltage regulation portion connected in parallel with a second voltage regulation portion that regulates a voltage if an open condition occurs within the first voltage regulation portion. In certain embodiments each voltage regulation portion includes a first voltage regulator connected in series with a second voltage regulator that regulates the voltage if a short condition occurs within the first voltage regulator.

In another embodiment, the first voltage regulator is nearest to an input relative to the second voltage regulator, while in another embodiment, the first voltage regulator is nearest to an output relative to the second voltage regulator.

In another embodiment, the regulation portions also include a switching element that routes an output voltage of the first voltage regulator past the second voltage regulator if the output voltage has been regulated, while in another embodiment, the switching element forces the output voltage to be regulated by the second voltage regulator if the output voltage has not been regulated.

In another embodiment of the present invention, a design structure embodied in a machine readable medium for designing, manufacturing, or testing an integrated circuit includes a first voltage regulation portion connected in parallel with a second voltage regulation portion that regulates a voltage if an open condition occurs within the first voltage regulation portion. In certain embodiments, each voltage regulation portion includes a first voltage regulator connected in series with a second voltage regulator that regulates the voltage if a short condition occurs within the first voltage regulator.

In another embodiment, the design structure includes the first voltage regulator being nearest to an input relative to the second voltage regulator, while in other embodiments, the design structure includes the first voltage regulator being nearest to an output relative to the second voltage regulator.

In another embodiment, the regulation portions of the design structure includes a switching element that routes an output voltage of the first voltage regulator past the second voltage regulator if the output voltage has been regulated.

In another embodiment the switching element of the design structure forces the output voltage to be regulated by the second voltage regulator if the output voltage has not been regulated.

In another embodiment the design structure includes a netlist, and in other embodiments the design structure resides on storage medium as a data format used for the exchange of layout data of integrated circuits.

In another embodiment of the present invention, a method includes regulating a voltage with a first voltage regulation portion connected in parallel with a second voltage regulation portion, and regulating the voltage with the second voltage regulation portion if an open condition occurs within the first voltage regulation portion.

In another embodiment, regulating the voltage with the first voltage regulation portion includes regulating the voltage with a first voltage regulator connected in series with a second voltage regulator, and regulating the voltage with the second voltage regulator if a short condition occurs within the first voltage regulator.

In another embodiment, regulating the voltage with the second voltage regulation portion further includes regulating the voltage with a third voltage regulator connected in series with a fourth voltage regulator, and regulating the voltage with the fourth voltage regulator if a short condition occurs within the third voltage regulator.

In other embodiments, the first voltage regulator is nearest an input relative to the second voltage regulator, the third voltage regulator is nearest an output relative to the fourth voltage regulator, the first voltage regulator is nearest an output relative to the second voltage regulator, and/or the third voltage regulator is nearest an output relative to the fourth voltage regulator.

BRIEF DESCRIPTION OF THE FIGURES

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
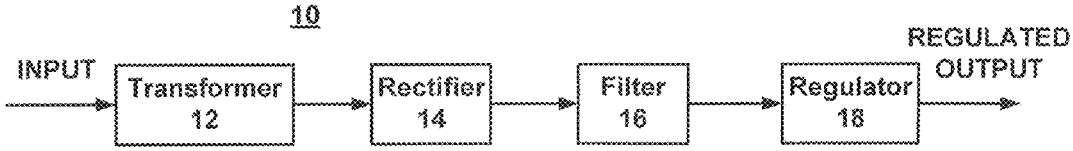
FIG. 1 depicts an exemplary power supply system that may utilize, or otherwise allow the operation of the various embodiments of the present invention.

For a better understanding of the various embodiments of the present invention, together with other and further features and advantages thereof, reference is made to the following description, taken in conjunction with the accompanying drawings, and the scope of the invention asserted in the claims.

It will be readily understood that the components of the present invention, as generally described and illustrated in the Figures herein, may be arranged and predetermined in a wide variety of different configurations. Thus, the following more detailed description of the embodiments of the circuits, design structure, and methods of the present invention, as represented in FIGS. 1-11, are not intended to limit the scope of the invention, as claimed, but is merely representative of selected exemplary embodiments of the invention.

As will be appreciated by one skilled in the art, various embodiments of the present invention may be embodied as a system, apparatus, method, design structure, computer program product or a combination thereof. Accordingly, embodiments of the present invention may take the form of an entirely hardware embodiment, an entirely software embodiment (including firmware, resident software, micro-code, etc.), or an embodiment combining software and hardware aspects that may all generally be referred to, for example as a "circuit," "module" or "system." Furthermore, embodiments of the present invention may take the form of a computer program product embodied in any tangible medium of expression having computer usable program code embodied in the medium.

Reference throughout this specification to "one embodiment" or "an embodiment" (or the like) means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. In addition, features described in connection with a particular embodiment may be combined or excluded from other embodiments described herein.

Embodiments of the present invention are described below with reference to flowchart illustrations and/or block diagrams of methods, apparatus, design structures, and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, a magnetic or other such storage device, or a design process system utilized in the design, manufacturing, and or testing of an electronic component or system.

In some alternative implementations, the functions noted in the block may occur out of the order noted in the figures. For example, two blocks shown in succession may, in fact, be executed concurrently, or the blocks may sometimes be executed in the reverse order, depending upon the functionality involved.

Design structures used in the design, manufacturing, or testing of the power regulation schemes described herein may be utilized to distribute a representation of the power regulation schemes from or to a computer system. The distribution may be on a distribution medium such as floppy disk or CD-ROM or may be on over a network such as the Internet using FTP, HTTP, or other suitable protocols. From there, the representation of the power regulation schemes may be copied to a hard disk or a similar intermediate storage medium and later utilized in the design, manufacturing, or testing.

FIG. 1 depicts an exemplary power supply system 10 that may utilize a voltage regulation scheme described herein according to an embodiment of the present invention. Power supply system 10 for example converts high voltage AC current to a suitable voltage supply for electronics circuits and other electronic devices such as a computer system, general purpose server, personal computer, laptop, sub-notebooks, television, etc. Power supply system 10 may include for example a transformer 12, a rectifier 14, a filter 16, and a regulator 18. Transformer 12 steps down high voltage AC to a lower voltage AC. Rectifier 14 converts AC voltage to DC voltage. The DC output of rectifier 14 may still have some variability and if so, filter 16 further flattens the DC voltage to have a smaller variability. Regulator 18 effectively further removes DC voltage variability and outputs a regulated DC voltage.

Figure 2:
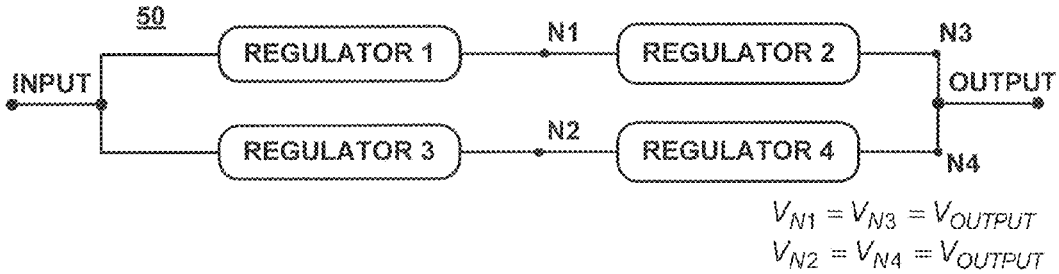
FIG. 2 depicts a voltage regulator scheme according to various embodiments of the present invention.

FIG. 2 depicts a voltage regulator scheme according to an embodiment of the present invention. In FIG. 2, the exemplary voltage regulator scheme is shown as circuit 50. Circuit 50 includes regulator 1 connected to regulator 2 in series; forming a first regulator pair or branch. Circuit 50 also comprises regulator 3 connected to regulator 4 in series; forming a second regulator pair or branch. The first regulator pair is connected in parallel with the second regulator pair. In other embodiments, circuit 50 may however include more regulators in series in each series branch thus forming regulator triplets, quadruplets, etc. In these embodiments, each regulator pair, triplet, quadruplet, etc., are electrically connected in parallel. Circuit 50 regulates a variable input voltage to a predetermined regulated output voltage that may be utilized by other electronic components within the electronic system.

Regulators 1-4 each separately regulate the predetermined input voltage to the predetermined regulated output voltage. Therefore, for example, when the electronic system and circuit 50 are operating as predicted, the actual regulated voltage at node N1 is the predetermined regulated output voltage. However when a fault occurs within one or more of the elements circuit 50, the multiple branch and alternative element regulation scheme further described below allows for a maintained and predictable output voltage.

In certain embodiments each regulator is of a similar regulator type (e.g., linear regulator with external pass MOSFET, step down regulator, etc.).

There are numerous fault conditions that may occur within circuit 50. For example, the reference voltage utilized by a regulator controller (described further below) may not be constant, a capacitor may short, a resistor or transistor may short or open, there may be bad solder joints, etc. Though there are numerous types of faults, the affects of these faults upon circuit 50 are similar to the affects of four faults that will be focused upon in the remaining specification. One skilled in the art will realize the schemes provided herein provide benefits for overcoming not only these four faults but for other fault types as well. These four faults are a short through a conducting field effect transistor (FET) channel, an open of a conducting FET channel, a FET gate drive open, or a FET gate drive short.

A short through a conducting FET channel allows electrical current to bypass the voltage regulator associated with the shorted FET. A gate drive short can be a short to a power domain or malfunction of the associated regulator controller such that it holds the FET in conduction, thus preventing proper modulation of the gate drive.

An open of a conducting FET channel does not allow electrical current to flow through the regulator circuitry. A gate drive open may be caused by lack of drive from the regulator controller, or potentially an electrical short causing the gate to be in the off position.

Since the effects of a short through a FET channel fault and a FET gate drive short fault are similar, in the following specification, these faults may be deemed separately or in combination as a short condition. And since the effects of an open of a FET channel fault and a FET gate drive open fault are also similar, in the following specification, these faults may be deemed separately or in combination as an open condition.

If a short condition occurs within regulator 1, the input voltage will pass to regulator 2 without being regulated as predetermined. Regulator 2 therefore regulates the input voltage to an actual regulated voltage at node N3 equal to the predetermined regulated output voltage. Likewise, if a short condition occurs within regulator 2 and regulator 1 has no faults, the voltage at node N1 will have been regulated by regulator 1 and will equal the predetermined regulated output voltage. In other words, Regulator 1 or alternatively Regulator 2 regulates the input voltage to the predetermined output voltage (if an open condition has not occurred within the first regulator pair).

If an open condition occurs within either regulator 1 or regulator 2, electrical current is prevented from flowing through the first regulator pair. However, electrical current will alternatively flow through the second regulator pair and the second regulator pair will regulate the input voltage to the predetermined regulated output voltage in a similar manner as described in the paragraph directly above.

Figure 3:
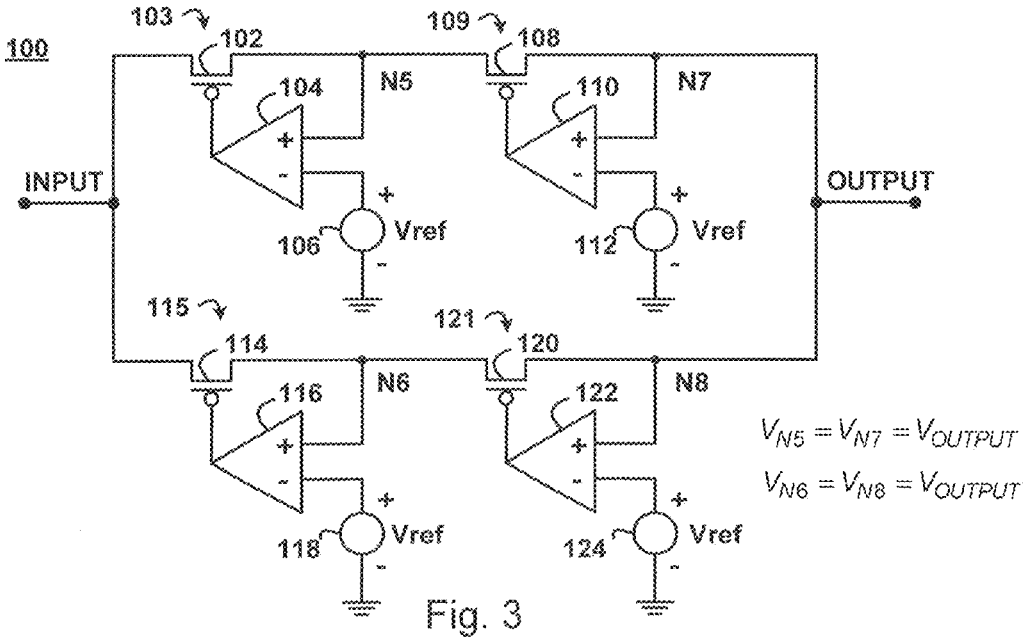
FIG. 3 depicts another voltage regulator scheme according to various embodiments of the present invention.

FIG. 3 depicts another voltage regulator scheme according to an embodiment of the present invention. The exemplary voltage regulator scheme is shown as circuit 100. Circuit 100 includes regulator 103, regulator 109, regulator 115, and regulator 121. Circuit 100 may also include more regulators in series in each series branch or more regulator pairs in parallel. Regulator 109 and regulator 103 are connected in series and form a first regulator pair, or branch, preventing adverse voltage regulation effects to the predetermined regulated output voltage caused by a short condition within either regulator 103 or regulator 109 respectively. Regulator 115 and regulator 121 are connected in series and form a second regulator pair, or branch, preventing adverse voltage regulation effects to the predetermined regulated output voltage caused by a short condition in either regulator 121 or regulator 115 respectively. Regulator 115 and regulator 121 also prevent adverse voltage regulation effects to the predetermined regulated output voltage caused by an open condition within either regulator 103 or within regulator 109.

Regulator 103 includes a switching element 102 and a feedback controller 104. By monitoring the voltage at node N5 and driving a variable voltage to switching element 102, feedback controller 104 keeps the voltage at node N5 equal to the predetermined regulated output voltage. Connected to one input of the feedback controller 104 is a voltage source 106 supplying a voltage Vref. Connected to the other input of the feedback controller 104 is the voltage at node N5.

Similarly, regulator 109 includes a switching element 108 and a feedback controller 110. By monitoring the voltage at node N7 and driving a variable voltage to switching element 108, feedback controller 110 keeps the voltage at node N7 equal to the predetermined regulated output voltage. Connected to one input of the feedback controller 110 is a voltage source 112 supplying a voltage Vref. Connected to the other input of the feedback controller 110 is the voltage at node N7.

Likewise, regulator 115 includes a switching element 114 and a feedback controller 116. By monitoring the voltage at node N6 and driving a variable voltage to switching element 114, feedback controller 116 keeps the voltage at node N6 a predetermined and anticipated fixed value equal to the desired output voltage. Connected to one input of the feedback controller 116 is a voltage source 118 supplying a voltage Vref. Connected to the other input of the feedback controller 116 is the voltage at node N6.

Regulator 121 includes a switching element 120 and a feedback controller 122. By monitoring the voltage at node N8 and driving a variable voltage to switching element 120, feedback controller 122 keeps the voltage at node N8 a predetermined and anticipated fixed value equal to the desired output voltage. Connected to one input of the feedback controller 122 is a voltage source 124 supplying a voltage Vref. Connected to the other input of the feedback controller 122 is the voltage at node N8.

In certain embodiments, the switching elements described above may be field effect transistors (NFET, PFET, etc.), NPN transistors, etc., and the feedback controllers described above may be operational amplifiers (op amps). In each regulator, the feedback controller attempts to make its two input voltages equal. Since one of the feedback controller inputs (Vref) stays constant, the feedback controller will adjust its output voltage in order to make its two input voltages equal.

Therefore, ultimately the voltage at node N5, node N6, node N7, and node N8 are regulated voltages.

Figure 4:
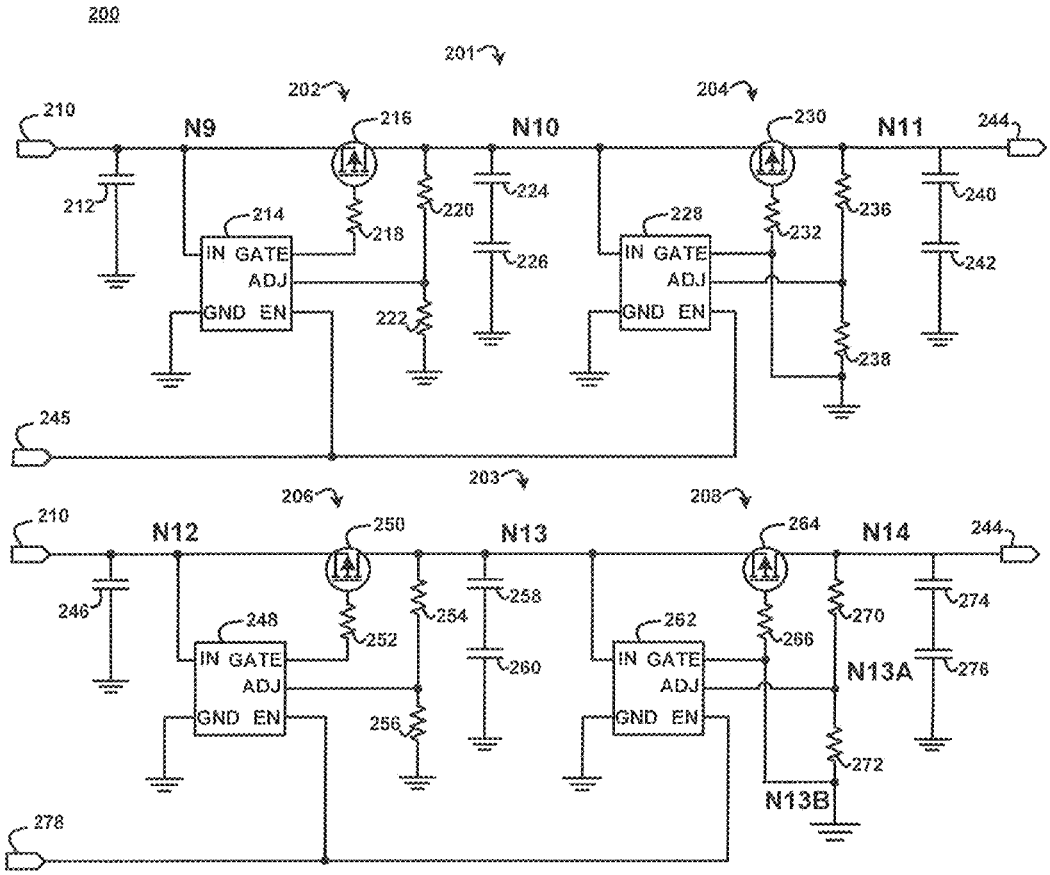
FIG. 4 depicts yet another voltage regulator scheme according to various embodiments of the present invention.

FIG. 4 depicts yet another voltage regulator scheme according to various embodiments of the present invention. The exemplary voltage regulator scheme is shown as circuit 200. Circuit 200 includes at least a regulator 202, a regulator 204, a regulator 206, and a regulator 208. Regulator 202 and regulator 204 are connected in series and form a regulator pair 201, and prevent adverse voltage regulation effects to a predetermined regulated output voltage 244 caused by a short condition in either regulator 204 or regulator 202 respectively. Regulator 206 and regulator 208 are connected in series and form a regulator pair 203, and prevent adverse voltage regulation effects to the predetermined regulated output voltage 244 caused by a short condition in either regulator 208 or regulator 206 respectively. Regulator 206 and regulator 208 also prevent adverse voltage regulation effects to the predetermined regulated output voltage 244 caused by an open condition in either regulator 202 or in regulator 204. In other embodiments, circuit 200 may include more regulators electrically connected in series in each series branch or more regulator pairs in connected to the first and second regulator pairs in parallel.

Circuit 200 includes a voltage input 210 and the predetermined regulated voltage output 244. Voltage input 210 is the unregulated voltage that is regulated by regulator pair 201 or regulator pair 203. Predetermined regulated voltage output 244 is the voltage regulated by regulator pair 201 or regulator pair 203.

Regulator 202 includes a linear controller 214 and a switching device 216, and regulator 204 includes a linear controller 228 and a switching device 230. Similarly, regulator 206 includes a linear controller 248 and a switching device 250, and regulator 208 includes a linear controller 262 and a switching device 264.

Linear controller 214 has a voltage input 210 connected to IN and a voltage output N10 connected to ADJ. Linear controller 214 attempts to make the voltage of its two inputs equal by adjusting its output at GATE. Ultimately, the voltage at node N10 is a regulated voltage. The voltage input 210 of regulator pair 201 is at node N9 and is an input IN to linear controller 214. An input capacitor 212 and the switching device 216 are also connected at node N9. Input capacitor 212 smoothes or otherwise filters electrical current driven to switching device 216 and may be utilized by the filter 16 shown in FIG. 1. Linear controller 214 drives voltage to switching element 216 through resistor 218. Resistor 218 is used to reduce ringing on the gate which is caused by parasitic inductance and capacitance. ADJ is connected to node N10 though resistor 220 and connected to ground through resistor 222. Output capacitors 224 and 226 are connected to node N10 to enable linear controller 214 to properly regulate a voltage at node 10. Capacitors 224 and 226 may be a combined single capacitor but when connected in series, prevent a single point of failure for increased short immunity.

Linear controller 228 has a voltage input at node N10 connected at IN and a voltage output N11 connected to ADJ. Linear controller 228 attempts to make the voltage of its two inputs equal by adjusting its output at GATE. The voltage at node N10 may be either input voltage 210 (if a short condition exists within regulator 202) or the regulated output voltage of regulator 202. If the voltage at node N10 is the input voltage 210, regulator 204 regulates the input voltage 210 to the predetermined regulated output voltage 244. If the voltage at node N10 is the regulated output voltage of regulator 202 (regulator 202 regulated input voltage 210 as expected), switching device 230 is either off or on depending on the device type. Ultimately, however, regulator 204 is effectively bypassed.

Ultimately, input voltage 210 is regulated by either regulator 202 or regulator 204 (if at least one of these regulators does not encounter a fault) and the voltage at node N11 is the regulated output voltage 244. The voltage at node N10 is an input IN to linear controller 228 and the switching device 230 is connected at node N10. Linear controller 228 drives voltage to the switching element 230 through resistor 232. Resistor 232 is used to reduce ringing on the gate which is caused by parasitic inductance and capacitance. Linear controller 228 has a voltage output N10 connected to ADJ. ADJ is connected to node N11 though resistor 236 and connected to ground through resistor 238. Output capacitors 240 and 242 are connected to node N11 to enable linear controller 228 to properly regulate the voltage at node 11. Capacitors 240 and 242 may be a combined single capacitor but, when connected in series, prevent a single point of failure for increased short immunity.

Linear controller 214 and linear controller 228 may receive an enable input EN from a voltage 245. The enable input EN may effectively turn linear controller 214 and linear controller 228 off or on.

As noted above, regulator 206 and regulator 208 prevent adverse voltage regulation effects to the predetermined regulated output voltage 244 caused by either a short condition or an open condition in either regulator 206 or regulator 208. Therefore, in certain embodiments, regulator 206 and regulator 208 are effectively bypassed if regulator 202 or regulator 204 are functioning as anticipated.

If a short condition or an open condition exists in regulator 206 or regulator 208, regulator 206 and/or regulator 208 regulates the input voltage 210 to the predetermined regulated output voltage 244. In this circumstance, linear controller 248 has a voltage input 210 connected at IN and a voltage output N13 connected to ADJ. Linear controller 248 attempts to make the voltage of its two inputs equal by adjusting its output at GATE. Ultimately, the voltage at node N13 is a regulated voltage. The voltage input 210 of regulator pair 203 is at node N12 and is an input IN to linear controller 248. An input capacitor 246 and the source of switching device 250 are also connected at node N12. Input capacitor 246 smoothes or otherwise filters electrical current driven to switching device 250 and may be utilized by filter 16 shown in FIG. 1. Linear controller 248 drives voltage to switching element 250 through resistor 252. Resistor 252 is used to reduce ringing on the gate which is caused by parasitic inductance and capacitance. Linear controller 248 is also connected to node N13 through resistor 254 and connected to ground through resistor 256. Output capacitors 258 and 260 are connected to node N13 to enable linear controller 248 to properly regulate a voltage at node N13. Capacitors 258 and 260 may be a combined single capacitor but when connected in series, prevent a single point of failure for increased short immunity.

Linear controller 262 has a voltage input at node N13 connected at IN, and a voltage output N14 connected at ADJ. Linear controller 262 attempts to make the voltage of its two inputs equal by adjusting its output at GATE. The voltage at node N13 may be either input voltage 210 (if an open condition exists within regulator 206) or the regulated output voltage of regulator 206. If the voltage at node N13 is the input voltage 210, regulator 206 regulates the input voltage 210 to the predetermined regulated output voltage 244. If the voltage at node N13 is the predetermined regulated output voltage of regulator 206 (regulator 206 regulated input voltage 210 as expected), switching device 264 is either off or on depending on the device type. Ultimately, however, regulator 208 is effectively bypassed.

The voltage at node N13 is an input IN to linear controller 262, and switching device 264 is connected at node N13. Linear controller 262 drives voltage to switching element 264 through resistor 266. Resistor 266 is used to reduce ringing on the gate which is caused by parasitic inductance and capacitance. Linear controller 262 receives output voltage N14 by the pin ADJ. Resistor 270 is connected between node N14 and node N13A. Resistor 272 is connected between node N13A and node N13B (at ground voltage). Output capacitors 274 and 276 are connected to node N14 to enable linear controller 262 to properly regulate the voltage at node 14. Capacitors 274 and 276 may be a combined single capacitor but, when connected in series, prevent a single point of failure for increased short immunity.

Ultimately, input voltage 210 is regulated by either regulator 206 or regulator 208 and the voltage at node N14 is the predetermined regulated output voltage 244.

Linear controller 248 and linear controller 262 may receive an enable input EN from a voltage 278. The enable input EN may effectively turn linear controller 248 and linear controller 262 off or on.

In certain embodiments, switching elements 216, 230, 250, and 264 may be field effect transistors (NFET, PFET, etc.), NPN transistors, etc., and linear controllers 214, 228, 248, and 262 may be op amps, etc. In certain embodiments linear controllers 214, 228, 248, and 262 may be MIC5159 type controllers available and manufactured by Micrel Inc.

Figure 5:
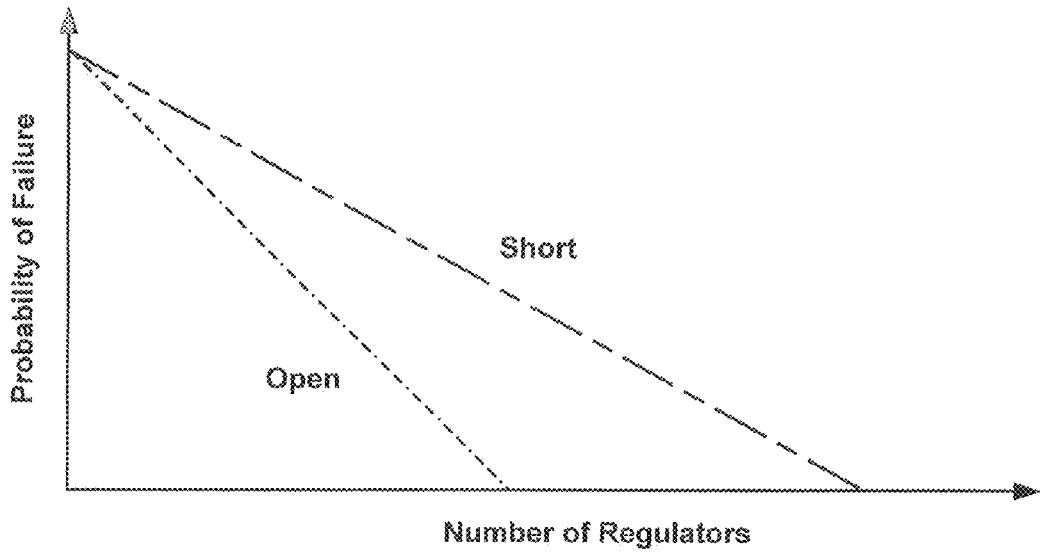
FIG. 5 depicts a general relationship of the probability of failure versus the number of regulators according to embodiments of the present invention.

FIG. 5 depicts a general relationship of the probability of failure versus the number of regulators for various failure types according to embodiments of the present invention. In analyzing of a particular regulator scheme, it may be determined that a particular fault condition may be more likely than another fault condition to occur within individual regulators. Because a first fault condition may be more likely than a second fault condition, a designer may add more regulators in series to one or more series branches. This practice may result in regulator triplets, quadruplets, etc. The designer may also add one or more regulator pairs, triplets, quadruplets, etc., in parallel. An example is provided below.

Figure 6:
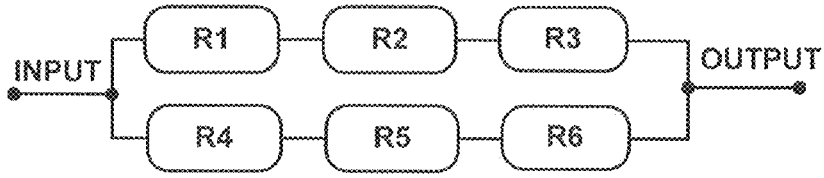
FIG. 6 depicts a regulator scheme having more voltage regulators in series than in parallel according to various embodiments of the present invention.

FIG. 6 depicts a regulator scheme having more voltage regulators in series than in parallel according to various embodiments of the present invention. In other words, FIG. 6 depicts two regulator triplets are connected in parallel. It may be determined that the probability of a short occurring within a particular regulator is greater than the probability of an open condition occurring within the particular regulator. Therefore, a larger number of regulators may be placed in series than there are regulators placed in parallel.

Figure 7:
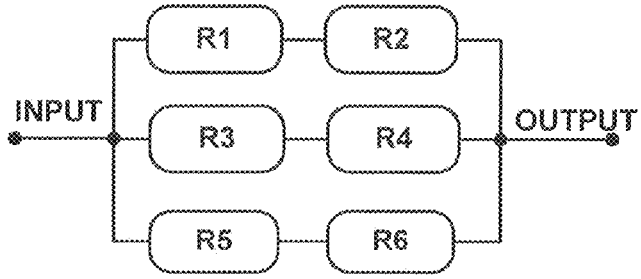
FIG. 7 depicts a regulator scheme having more voltage regulators in parallel than in series according to various embodiments of the present invention.

FIG. 7 depicts a regulator scheme having more voltage regulators in parallel than in series according to various embodiments of the present invention. In other words, FIG. 7 depicts a third regulator pair connected in parallel to two other regulator pairs connected in parallel. It may be determined that the probability of an open condition occurring within a particular regulator is greater than the probability of a short condition occurring within the particular regulator. Therefore, a larger number of regulators may be placed in parallel than there are regulators placed in series.

Figure 8:
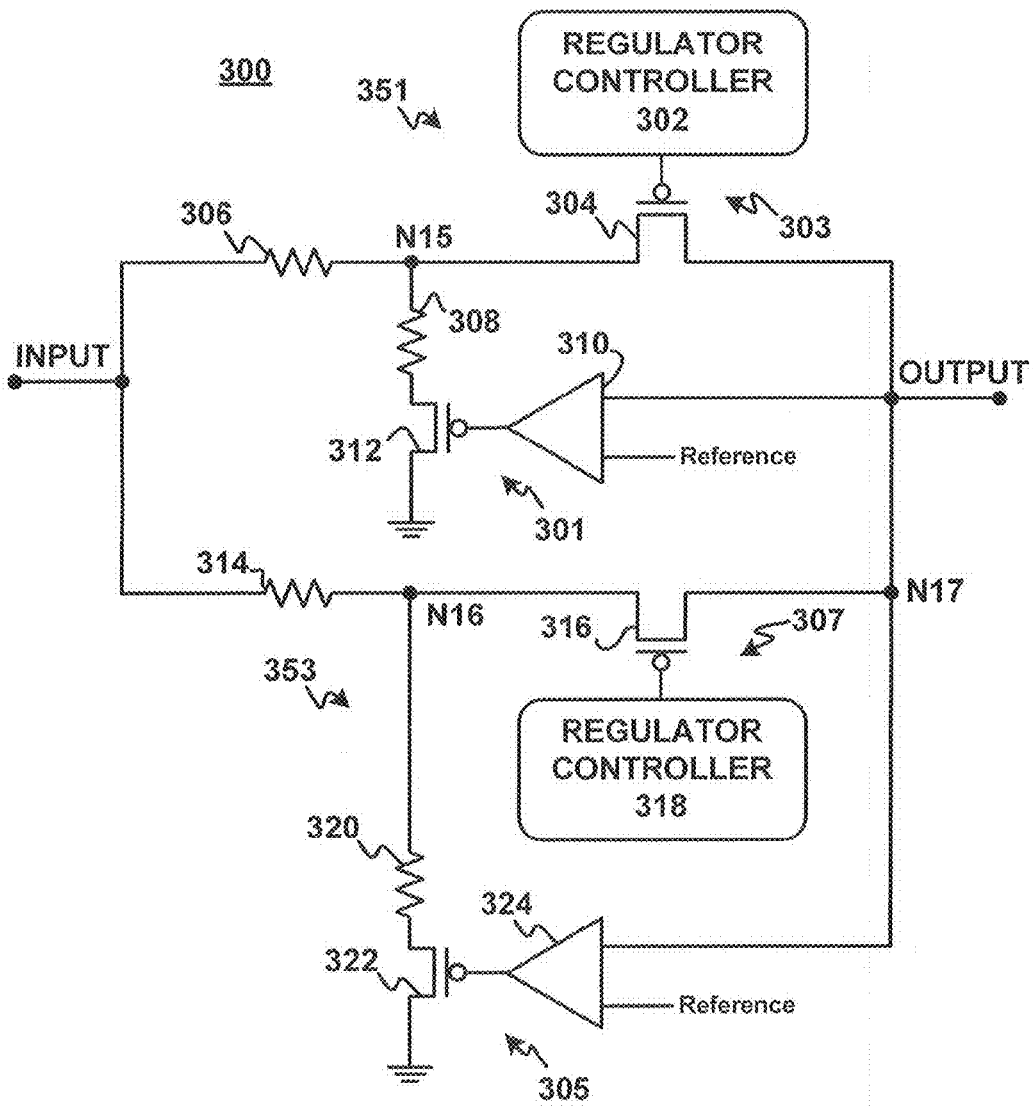
FIG. 8 depicts yet another voltage regulator scheme according to various embodiments of the present invention.

FIG. 8 depicts yet another voltage regulator scheme according to various embodiments of the present invention. The exemplary voltage regulator scheme is shown as circuit 300. Circuit 300 utilizes a shunt device instead of an upstream regulator controller as utilized by circuit 100 and 200 described above. Circuit 300 includes at least four voltage regulators: shunt regulator 301, series regulator 303, shunt regulator 305, and series regulator 307. Shunt regulator 301 is connected to series regulator 303 in series and forms a regulator pair 351. Shunt regulator 305 is similarly connected to series regulator 307 in series and forms a regulator pair 353. Circuit 300 regulates an input voltage to the predetermined regulated output voltage at node N17. Circuit 300 is configured so that the predetermined regulated output voltage is similar before and after a single failure of a single component within circuit 300.

In another embodiment, regulator controller 302 includes a switching element that lowers the voltage applied to regulator controller 318 if the actual output voltage of regulator controller 318 is greater than the predetermined regulated output voltage.

Shunt regulator 301 includes resistor 306, resistor 308, linear regulator controller 310, and switching element 312. Series regulator 303 includes a linear regulator controller 302 and a switching element 304. Shunt regulator 305 includes resistor 314, resistor 320, linear regulator controller 324, and switching element 322. Series regulator 307 includes a linear regulator controller 318 and a switching element 316.

Resistor 306 is connected between the voltage input of circuit 300 and node N15. Resistor 306 forms a voltage divider with resistor 308 and switching element 312. Resistor 306 is utilized to allow shunt regulator 301 to limit voltage at node N15 if a short condition occurs within switching element 304.

Resistor 308 is connected between node N15 and switching element 312. Resistor 308 forms a voltage divider with resistor 306 and switching element 312. Resistor 308 is utilized to allow shunt regulator 301 to limit voltage at node N15 if a short condition occurs within switching element 304. Further, if a short condition occurs within switching element 312, the voltage at N15 is equal to the divided voltage formed by resistor 306 and resistor 308. The voltage at N15 should be less than the predetermined output voltage so that there is no direct short to ground.

If a short condition exists within resistor 306 the voltage at node N15 will equal the input voltage. However, series regulator 303 will regulate the input voltage to the predetermined output voltage. If an open condition exists within resistor 306, regulator pair 353 will regulate the input voltage to the predetermined output voltage.

There is no affect to the regulation of the input voltage if a short condition exists within resistor 308 since element 312 and resistor 306 are functional without resistor 308. If an open condition exists within resistor 308, the input voltage is regulated to the predetermined output voltage by series regulator 303.

Switching element 312 is connected to resistor 308, to ground, and linear regulator controller 310. Switching element 312 may be a PFET, NFET, etc. Switching element 312 limits the voltage at node N15 in the event of a short condition occurring within switching element 304.

Linear regulator controller 310 has two inputs: a reference voltage and the voltage at node N17. In certain embodiments, linear regulator controller 310 is an op-amp including a reference voltage input and a feedback loop input. Linear regulator controller 310 limits the voltage at node N15 in a short condition exists in switching element 304. If a short condition exists within linear controller 310, the voltage at node N15 will be equal to the divided voltage formed by resistor 306 and resistor 308. As noted above, the voltage at node N15 should be less than the predetermined regulated output voltage. If an open condition occurs within linear regulator controller 310, the voltage at node N15 is not affected and series regulator 303 regulates the input voltage to the predetermined output voltage.

Similarly, if a short condition occurs within switching element 312, the voltage at node N15 is also equal to the divided voltage formed by resistor 306 and resistor 308 and less than the predetermined regulated output voltage. Likewise, if an open condition occurs within switching element 312, the voltage at node N15 is not affected and series regulator 303 regulates the input voltage to the predetermined output voltage.

Switching element 304 is connected to node N15, to node N17, and to linear regulator controller 302. In certain embodiments, switching element 304 is a PFET, NFET, etc. Switching element 304 provides a variable resistance as set by linear regulator controller 302 to allow series regulator 303 to regulate the input voltage to the predetermined regulated output voltage. If a short condition exists within switching element 304, and if the voltage at N15 equals the output voltage, the feedback to linear regulator controller 310 will prevent the output voltage from going high. If an open condition exists within switching element 304, regulator pair 353 will continue to regulate the input voltage to the predetermined regulated output voltage.

Linear regulator controller 302 controls the voltage driven to switching element 304. If linear regulator controller 302 fails, the gate control to switching element 304 could get stuck high or stuck low. For example, in the case of switching element 304 being embodied as a PFET and the gate drive is stuck high, switching element 304 will act as if an open condition exists, and regulator pair 353 will continue to regulate the input voltage to the predetermined regulated output voltage. Switching element 304 will act as if a short condition exists, if the gate drive is stuck low, and shunt regulator 301 will continue to regulate the input voltage to the predetermined regulated output voltage.

If regulator pair 353 regulates the input voltage to the predetermined regulated output voltage because of a failure occurring within regulator pair 351, the circuit components in regulator pair 353 behave in a similar manner to the respective circuit components described above in regulator pair 351.

In certain embodiments, circuit 300 can reduce circuit component count and complexity as compared to other circuit structures. Resistors 306/314 and resistors 308/320 should be sized such as to limit the output voltage when switching element 312 turns on while also minimizing power lost through the components of shunt regulator 301. Circuit 300 is well suited for light power load applications where the savings of a regulator controller would be significant enough to justify loss of overall component efficiency.

Figure 9:
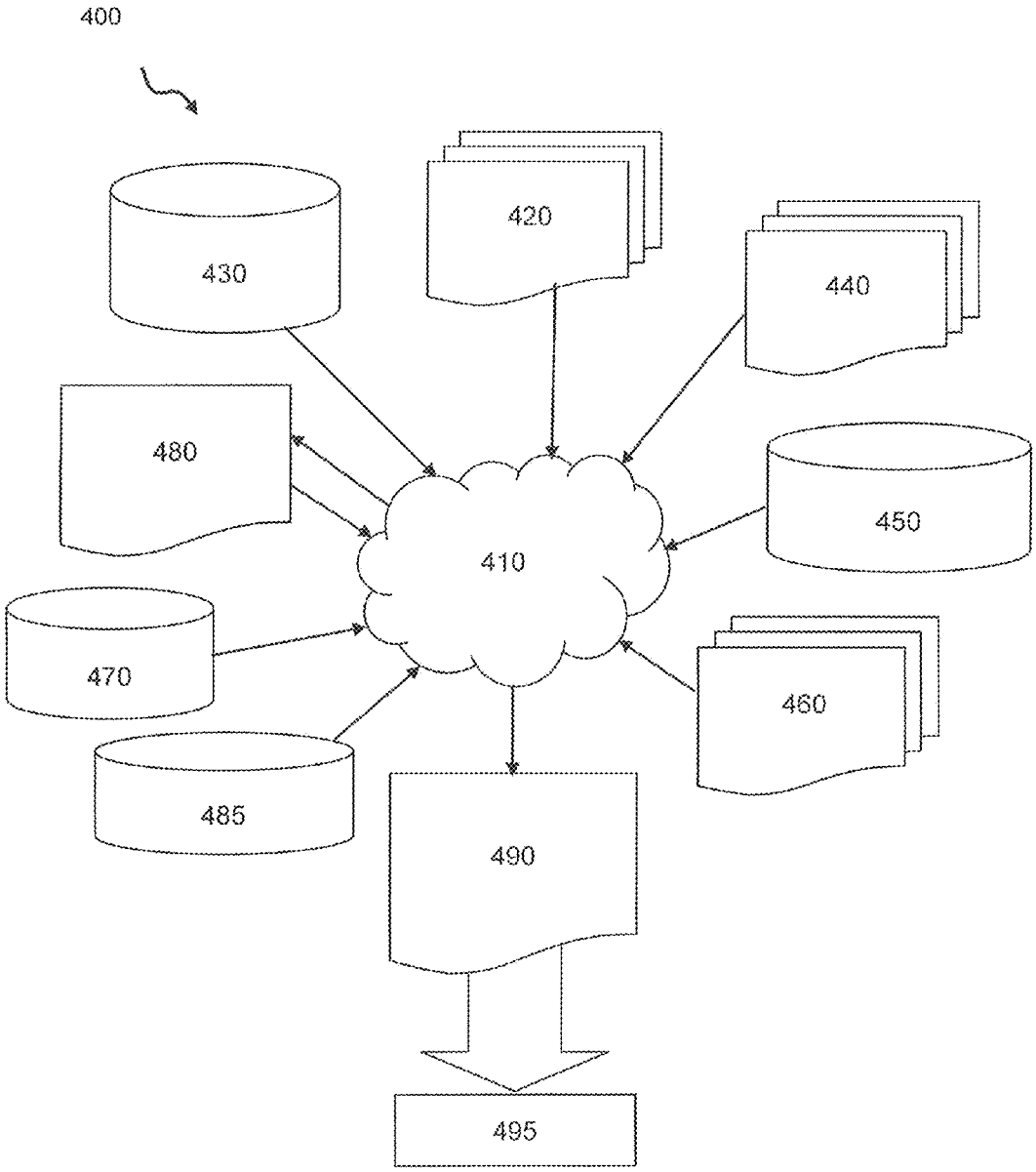
FIG. 9 depicts a block diagram of an exemplary design process utilized in the design, manufacturing, and or testing of a power supply or other electronic system utilizing a regulator scheme according to various embodiments of the present invention.

FIG. 9 depicts a block diagram of an exemplary design flow 400 utilized in the design, manufacturing, and or testing of a power supply, or other electronic system, utilizing a multiple regulator circuit according to various embodiments of the present invention. Design flow 400 may vary depending on the type of IC being predetermined. For example, a design flow 400 for building an application specific IC (ASIC) may differ from a design flow 400 for designing a standard component. Design structure 420 is preferably an input to a design process 410 and may come from an IP provider, a core developer, or other design company or may be generated by the operator of the design flow, or from other sources. Design structure 420 comprises translating circuit 200 in the form of schematics or HDL, a hardware-description language (e.g., Verilog, VHDL, C, etc.). Design structure 420 may be contained on one or more machine readable medium. For example, design structure 420 may be a text file or a graphical representation of translating circuit 200. Design process 410 preferably synthesizes (or translates) translating circuit 200 into a netlist 480, where netlist 480 is, for example, a list of wires, transistors, logic gates, control circuits, I/O, models, etc., that describes the connections to other elements and circuits in an integrated circuit design and recorded on at least one machine readable medium. This may be an iterative process in which netlist 480 is resynthesized one or more times depending on design specifications and parameters for the circuit.

Design process 410 may include using a variety of inputs; for example, inputs from library elements 430 which may house a set of commonly used elements, circuits, and devices, including models, layouts, and symbolic representations, for a given manufacturing technology (e.g., different technology nodes, 32 nm, 45 nm, 90 nm, etc.), design specifications 440, characterization data 450, verification data 460, design rules 470, and test data files 485 (which may include test patterns and other testing information). Design process 410 may further include, for example, standard circuit design processes such as timing analysis, verification, design rule checking, place and route operations, etc. One of ordinary skill in the art of integrated circuit design can appreciate the extent of possible electronic design automation tools and applications used in design process 410 without deviating from the scope and spirit of the invention. The design structure of the invention is not limited to any specific design flow.

Design process 410 preferably translates an embodiment of the invention as shown in FIG. 1-4, 8, or 11 along with any additional integrated circuit design or data, into a second design structure 490. Design structure 490 resides on a storage medium in a data format used for the exchange of layout data of integrated circuits (e.g., information stored in a GDSII (GDS2), GL1, OASIS, or any other suitable format for storing such design structures). Design structure 490 may comprise information such as, for example, test data files, design content files, manufacturing data, layout parameters, wires, levels of metal, vias, shapes, data for routing through the manufacturing line, and any other data required by a semiconductor manufacturer to produce an embodiment of the invention as shown in FIG. 1-4, 8, or 11. Design structure 490 may then proceed to a stage 495 where, for example, design structure 490: proceeds to tape-out, is released to manufacturing, is released to a mask house, is sent to another design house, is sent back to the customer, etc.

Figure 10:
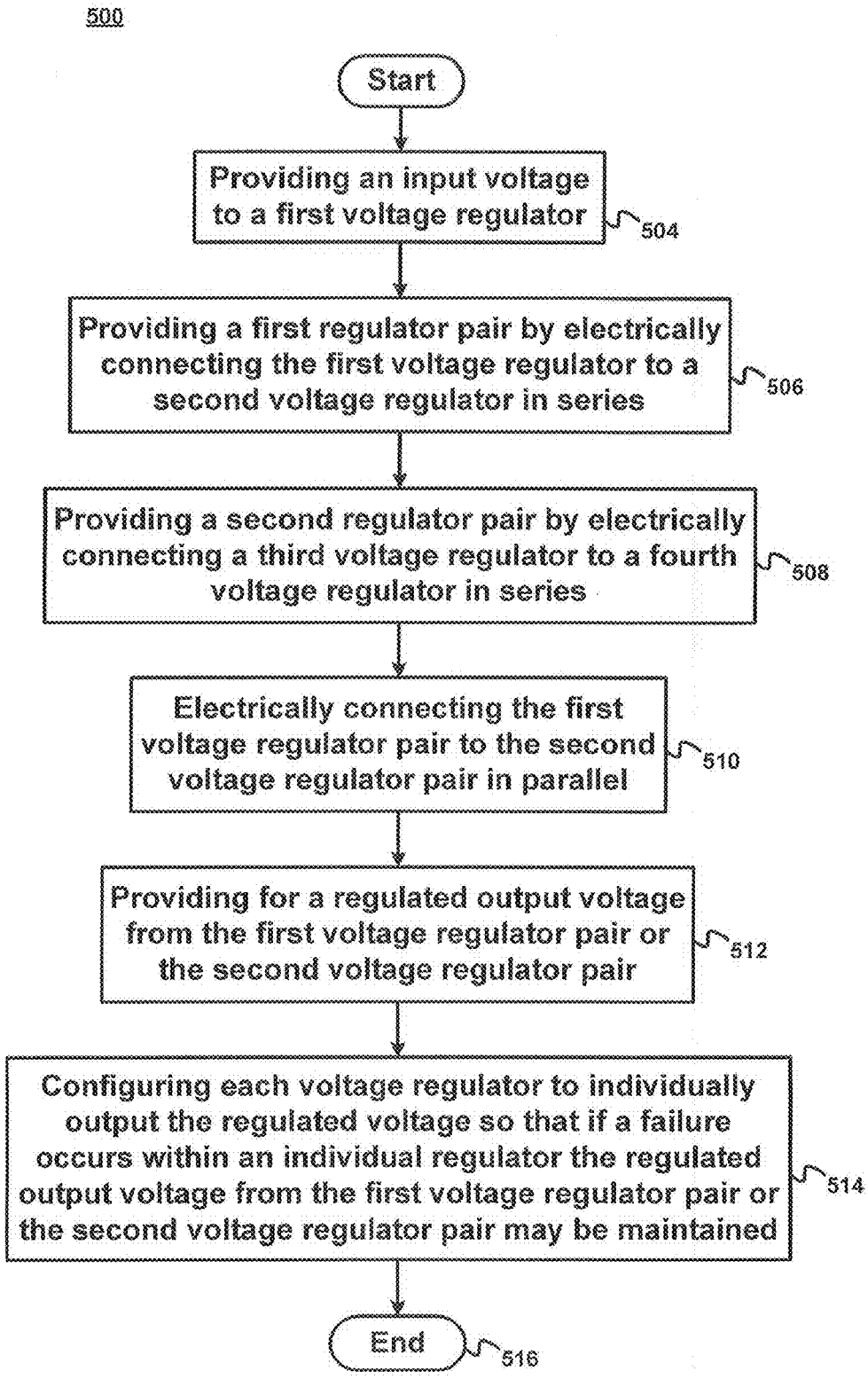
FIG. 10 depicts a method of manufacturing a voltage regulation circuit according to various embodiments of the present invention.

FIG. 10 depicts a method 500 of manufacturing a voltage regulation circuit according to various embodiments of the present invention. Method 500 begins at block 502. An input voltage is provided to a first voltage regulator (block 504). A first regulator pair is provided by electrically connecting the first voltage regulator to a second voltage regulator in series (block 506). A second regulator pair is provided by electrically connecting a third voltage regulator to a fourth voltage regulator in series (block 508). The first voltage regulator is electrically connected to the second voltage regulator pair in parallel (block 510). A regulated output voltage is provided from the first voltage regulator pair or the second voltage regulator pair (block 512). Each voltage regulator is configured to individually output the regulated voltage so that if a failure occurs within an individual regulator the regulated output voltage from the first voltage regulator pair or the second voltage regulator pair may be maintained (block 514). Method 500 ends at block 516.

Figure 11:
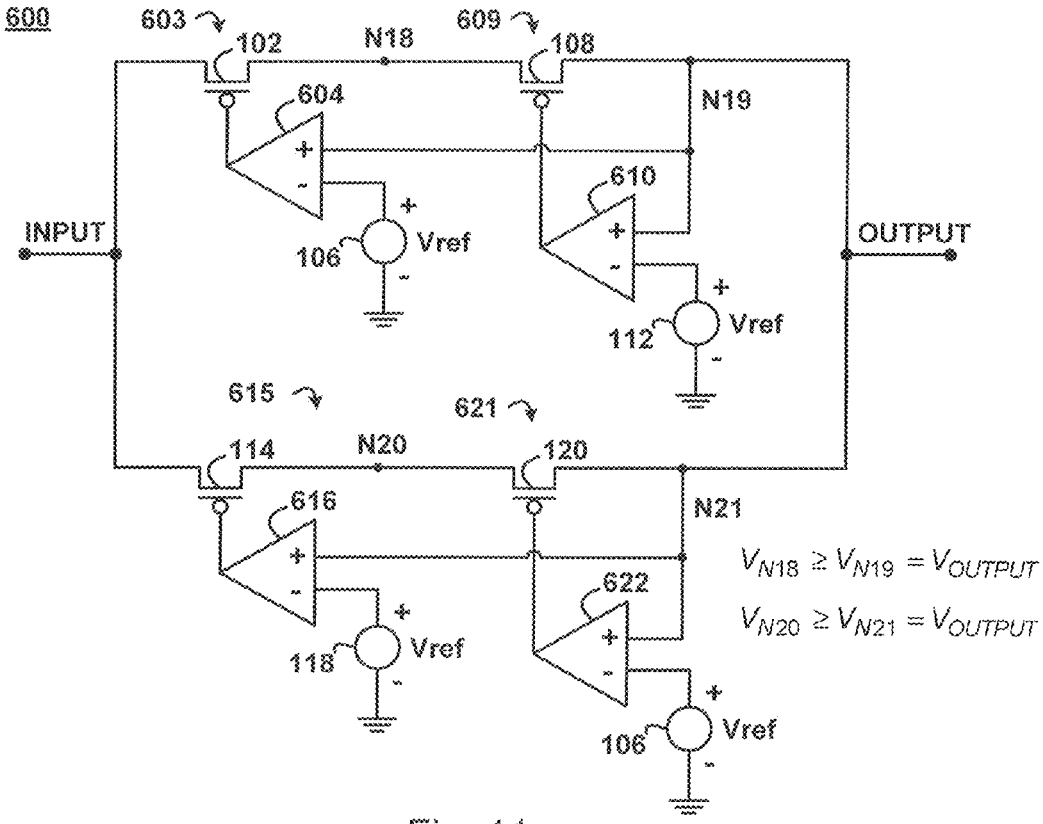
FIG. 11 depicts yet another voltage regulator scheme according to various embodiments of the present invention.

FIG. 11 depicts yet another voltage regulator scheme according to an embodiment of the present invention. The exemplary voltage regulator scheme is shown as circuit 600. Circuit 600 includes regulator 603, regulator 609, regulator 615, and regulator 621. Circuit 600 may also include more regulators in series in each series branch or more regulator pairs in parallel. Regulator 609 and regulator 603 are connected in series and form a first regulator pair, or branch, preventing adverse voltage regulation effects to the predetermined regulated output voltage caused by a short condition within either regulator 603 or regulator 609 respectively. Regulator 615 and regulator 621 are connected in series and form a second regulator pair, or branch, preventing adverse voltage regulation effects to the predetermined regulated output voltage caused by a short condition in either regulator 621 or regulator 615 respectively. Regulator 615 and regulator 621 also prevent adverse voltage regulation effects to the predetermined regulated output voltage caused by an open condition within either regulator 603 or within regulator 609.

Regulator 603 includes a switching element 102 and a feedback controller 604. By monitoring the voltage at node N19 and driving a variable voltage to switching element 102, feedback controller 604 keeps the voltage at node N18 greater than or equal to the predetermined regulated output voltage. Connected to one input of the feedback controller 604 is the voltage source 106 supplying a voltage Vref. Connected to the other input of the feedback controller 604 is the voltage at node N19.

Similarly, regulator 609 includes a switching element 108 and a feedback controller 610. By monitoring the voltage at node N19 and driving a variable voltage to switching element 108, feedback controller 610 keeps the voltage at node N19 equal to the predetermined regulated output voltage. Connected to one input of the feedback controller 610 is voltage source 112 supplying a voltage Vref. Connected to the other input of the feedback controller 610 is the voltage at node N19.

Likewise, regulator 615 includes a switching element 114 and a feedback controller 616. By monitoring the voltage at node N21 and driving a variable voltage to switching element 114, feedback controller 616 keeps the voltage at node N20 a greater than or equal to the desired output voltage. Connected to one input of the feedback controller 616 is voltage source 118 supplying a voltage Vref. Connected to the other input of the feedback controller 616 is the voltage at node N21.

Regulator 621 includes a switching element 120 and a feedback controller 622. By monitoring the voltage at node N21 and driving a variable voltage to switching element 120, feedback controller 622 keeps the voltage at node N8 at the predetermined regulated output voltage. Connected to one input of the feedback controller 622 is the voltage source 124 supplying a voltage Vref. Connected to the other input of the feedback controller 622 is the voltage at node N21.

It is to be understood that the present invention, in accordance with at least one present embodiment, includes elements that may be implemented to provide multiple branch alternative element Power regulation to at least one electronic enclosure, such as general-purpose server running suitable software programs.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

The accompanying figures and this description depicted and described embodiments of the present invention, and features and components thereof. Those skilled in the art will appreciate that any particular program nomenclature used in this description was merely for convenience and, thus, the invention should not be limited to use solely in any specific application identified and/or implied by such nomenclature. Thus, for example, the routines executed to implement certain embodiments of the invention, whether implemented as part of an operating system or a specific application, component, program, module, object, design structure, or sequence of instructions could have been referred to as a "program", "application", or other meaningful nomenclature. Therefore, it is desired that the embodiments described herein be considered in all respects as illustrative, not restrictive, and that reference be made to the appended claims for determining the scope of the invention.

The invention claimed is:

1. A power supply comprising:

a first voltage regulation portion connected in parallel with a second voltage regulation portion that regulates a voltage if an open condition occurs within the first voltage regulation portion; wherein each voltage regulation portion comprises:

a first voltage regulator connected in series with a second voltage regulator that regulates the voltage if a short condition occurs within the first voltage regulator; and a switching element that routes an output voltage of the first voltage regulator past the second voltage regulator if the output voltage is regulated.

2. The power supply of claim 1 wherein the first voltage regulator is nearest to an input relative to the second voltage regulator.

3. The power supply of claim 1 wherein the first voltage regulator is nearest to an output relative to the second voltage regulator.

4. The power supply of claim 1 wherein the switching element forces the output voltage to be regulated by the second voltage regulator if the output voltage has not been regulated.

5. The power supply of claim 1 further comprising:

a transformer, a rectifier, and a filter.

6. A design structure embodied in a non-transitory machine readable medium for designing, manufacturing, or testing an integrated circuit, the design structure comprising:

a first voltage regulation portion connected in parallel with a second voltage regulation portion that regulates a voltage if an open condition occurs within the first voltage regulation portion; wherein each voltage regulation portion comprises:

a first voltage regulator connected in series with a second voltage regulator that regulates the voltage if a short condition occurs within the first voltage regulator; and a switching element that routes an output voltage of the first voltage regulator past the second voltage regulator if the output voltage has been regulated.

7. The design structure of claim 6 wherein the first voltage regulator is nearest to an input relative to the second voltage regulator.

8. The design structure of claim 6 wherein the first voltage regulator is nearest to an output relative to the second voltage regulator.

9. The design structure of claim 6 wherein the switching element forces the output voltage to be regulated by the second voltage regulator if the output voltage has not been regulated.

10. The design structure of claim 6, wherein the design structure comprises a netlist.

11. The design structure of claim 6, wherein the design structure resides on storage medium as a data format used for the exchange of layout data of integrated circuits.

12. A method comprising:

regulating a voltage with a first voltage regulation portion connected in parallel with a second voltage regulation portion; and regulating the voltage with the second voltage regulation portion if an open condition occurs within the first voltage regulation portion;

wherein regulating the voltage with the first voltage regulation portion comprises:

regulating the voltage with a first voltage regulator connected in series with a second voltage regulator; and regulating the voltage with the second voltage regulator if a short condition occurs within the first voltage regulator;

wherein regulating the voltage with the second voltage regulation portion comprises:

regulating the voltage with a third voltage regulator connected in series with a fourth voltage regulator; and regulating the voltage with the fourth voltage regulator if a short condition occurs within the third voltage regulator.

13. The method of claim 12 wherein the first voltage regulator is nearest an input relative to the second voltage regulator.

14. The method of claim 12 wherein the third voltage regulator is nearest an output relative to the fourth voltage regulator.

15. The method of claim 12 wherein the first voltage regulator is nearest an output relative to the second voltage regulator.

16. The method of claim 12 wherein the third voltage regulator is nearest an output relative to the fourth voltage regulator.

* * * * *